US006999709B2

(12) United States Patent
Park

(10) Patent No.: US 6,999,709 B2
(45) Date of Patent: Feb. 14, 2006

(54) TRANSFER UNIT OF ELECTROPHOTOGRAPHIC IMAGE FORMING APPRARATUS

(75) Inventor: Geun-yong Park, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 134 days.

(21) Appl. No.: 10/687,965

(22) Filed: Oct. 20, 2003

(65) Prior Publication Data

US 2004/0136759 A1 Jul. 15, 2004

(30) Foreign Application Priority Data

Dec. 10, 2002 (KR) ..... 10-2002-0078161

(51) Int. Cl.
*G03G 15/01* (2006.01)

(52) U.S. Cl. ..... 399/302; 399/121

(58) Field of Classification Search ..... 399/107, 399/110, 121, 297, 298, 299, 302, 308, 306
See application file for complete search history.

(56) References Cited

U.S. PATENT DOCUMENTS 6,453,135 B1 * 9/2002 Sameshima et al. ..... 399/110
6,463,236 B1 * 10/2002 Morikami et al. ..... 399/121
6,484,003 B1 * 11/2002 Tokutake et al. ..... 399/110

* cited by examiner

*Primary Examiner*—Hoan Tran
(74) *Attorney, Agent, or Firm*—Staas & Halsey LLP

(57) ABSTRACT

A transfer unit of an electrophotographic image forming apparatus. The transfer unit includes a transfer belt which is rotated while contacting a photosensitive drum, a driving assembly having a driving roller supported by a plurality of main frames to rotate the transfer belt, and a steering roller portion supported by the plurality of main frames and which pushes the transfer belt to tighten the transfer belt. The apparatus further includes a transfer backup roller assembly having a plurality of transfer backup rollers which are installed inside the transfer belt to support a plurality of auxiliary frames and support the transfer belt, and a plurality of guide rollers supported by the plurality of auxiliary frames and to guide the transfer belt, and a transfer backup roller ascending and descending portion which ascends and descends the transfer backup roller assembly towards the driving assembly.

23 Claims, 12 Drawing Sheets

TRANSFER UNIT OF ELECTROPHOTOGRAPHIC IMAGE FORMING APPRARATUS

CROSS-REFERENCE TO RELATED APPLICATIONS

This application claims the priority of Korean Patent Application No. 2002-78161, filed Dec. 10, 2002, in the Korean Intellectual Property Office, the disclosure of which is incorporated herein by reference.

BACKGROUND OF THE INVENTION

1. Field of the Invention

The present invention relates to an electrophotographic image forming apparatus, and more particularly, to a transfer unit of an electrophotographic image forming apparatus, which transfers an image formed on a developing unit onto paper.

2. Description of the Related Art

In general, electrophotographic image forming apparatuses are devices which form an electrostatic latent image on a photosensitive medium, such as a photosensitive drum or a photosensitive belt, and develop the electrostatic latent image with toner of a predetermined color, and transfer the developed electrostatic latent image onto paper, thereby obtaining a desired image.

FIG. 1 schematically illustrates the structure of a conventional electrophotographic image forming apparatus. The electrophotographic image forming apparatus 100 includes a plurality of developing units 110 and a transfer unit 140. Although a plurality of the developing units 110 are included, the present description refers to a single developing unit 110 for simplicity of explanation.

The developing Unit 110 develops an electrostatic latent image formed on a photosensitive drum 130 by a laser scanning unit (LSU) 120 with a predetermined color.

The transfer unit 140 transfers the image, transferred from the photosensitive drum 130 onto a transfer belt 145, onto paper. The transfer belt 145 is rotatably supported by a transfer belt steering roller 141 to maintain tension of the transfer belt 145, a plurality of transfer backup rollers 142, and a driving roller 144. The photosensitive drum 130 is supported by each of a plurality of the transfer backup rollers 142, wherein the transfer belt 145 is placed therebetween.

Reference numeral 170 denotes a cleaning blade which is installed opposite to the transfer belt steering roller 141, wherein the transfer belt 145 is placed therebetween. The cleaning blade 170 closely contacts the transfer belt 145 with a predetermined pressure, and cleans a developing agent remaining on the transfer belt 145 after the image is transferred onto the paper.

A photosensitive drum cleaning blade 132, which contacts the surface of the photosensitive drum 130 and removes the developing agent remaining on the surface of the photosensitive drum 130, is installed adjacent to the photosensitive drum 130.

Although not shown, a fusing unit which fuses the transferred image on the paper is further installed.

In the conventional electrophotographic image forming apparatus 100 having the above structure, the transfer unit 140 closely contacts the photosensitive drum 130 with a predetermined pressure so that the image is transferred from the photosensitive drum 130 onto the transfer belt 145. However, when the transfer unit 140 or the developing unit 110 is replaced, the transfer belt 145 and the photosensitive drum 130 that closely contact each other to form the image on the transfer belt 145 must be spaced apart from each other. Thus, a device which can closely contact the transfer unit 140 or be spaced apart from the photosensitive drum 130, is required.

The photosensitive drum 130 and the transfer belt 145 must uniformly contact each other and require a low pressure and a high precision. However, the conventional transfer unit 140 includes a plurality of components, and is thus large and heavy.

The number of components of the transfer unit 140 becomes even larger, and the precision of the components is accordingly lowered. Thus, costs increase, the life span of the electrophotographic image forming apparatus is reduced, and it is inconvenient to use the electrophotographic image forming apparatus.

SUMMARY OF THE INVENTION

Accordingly, it is an aspect of the present invention to provide a transfer unit of an electrophotographic image forming apparatus having an improved structure in which precision when a transfer belt and a photosensitive medium contact each other is not reduced by closely adhering or spacing apart a plurality of transfer backup rollers to or from the photosensitive medium at the same time.

Additional aspects and advantages of the invention will be set forth in part in the description which follows and, in part, will be obvious from the description, or may be learned by practice of the invention.

According to an aspect of the present invention, there is provided a transfer unit of an electrophotographic image forming apparatus including a plurality of photosensitive drums, the transfer unit including: a transfer belt which has a closed shape, is rotated while contacting the photosensitive drums, onto which a toner image formed on the photosensitive drums is transferred, and which transfers the toner image onto a paper; a plurality of main frames; a driving assembly including: a driving roller which is installed inside of the transfer belt to be supported by the plurality of main frames and rotates and drives the transfer belt, and a steering roller portion which is installed inside of the transfer belt to be supported by the plurality of main frames and to push the transfer belt from the inside thereof to tighten the transfer belt; a plurality of auxiliary frames; a transfer backup roller assembly including: a plurality of transfer backup rollers which are installed inside of the transfer belt to be opposite to the photosensitive drums, the transfer belt being between one of the transfer backup rollers and the photosensitive drums and to be supported by the plurality of auxiliary frames and support the transfer belt so that the toner image formed on the photosensitive drums is transferred onto the transfer belt, and a plurality of guide rollers which are inside of the transfer belt to be supported by the plurality of auxiliary frames and guide the transfer belt; and a transfer backup roller ascending and descending portion which ascends and descends the transfer backup roller assembly towards and away from the driving assembly.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
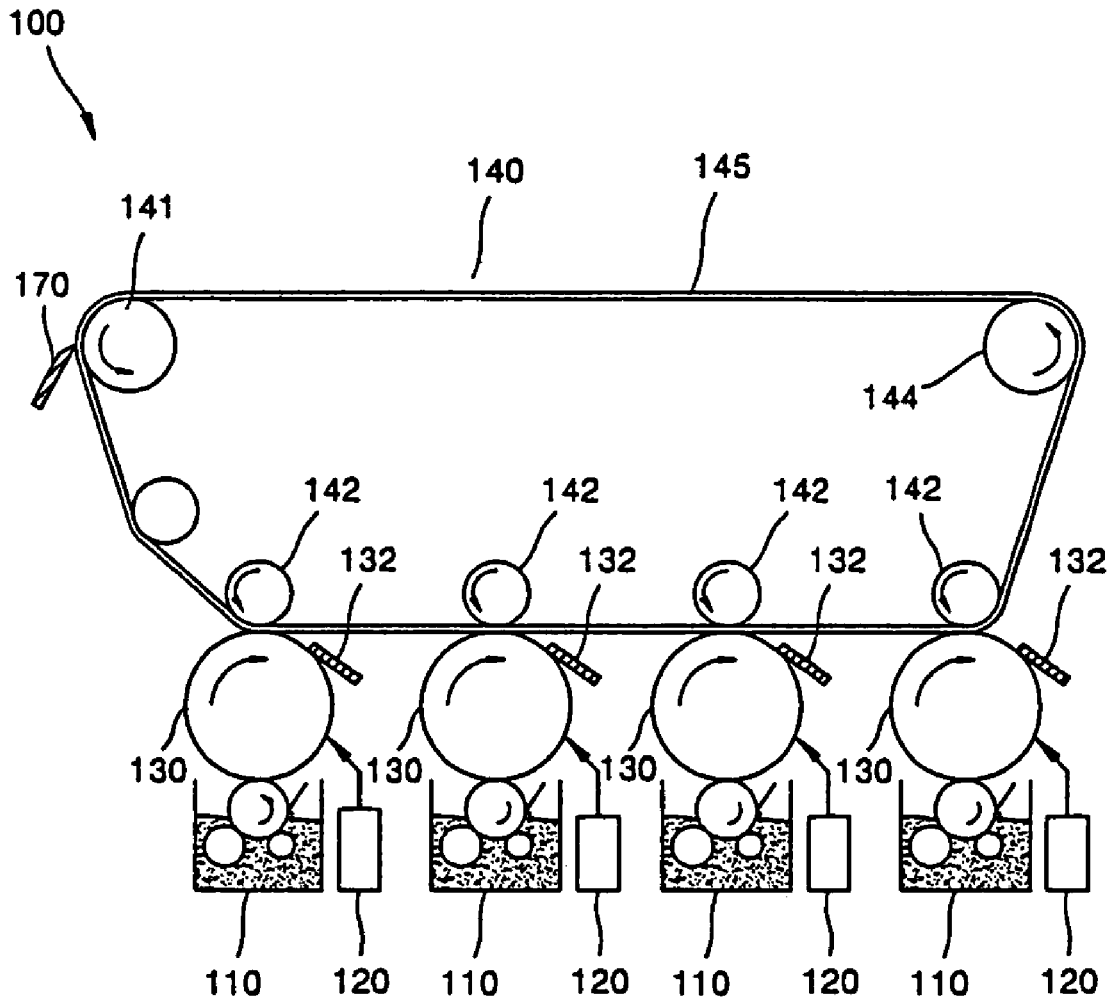
FIG. 1 (PRIOR ART)
FIG. 1 schematically illustrates the structure of a conventional electrophotographic image forming apparatus.

Reference will now be made in detail to the present preferred embodiments of the present invention, examples of which are illustrated in the accompanying drawings, wherein like reference numerals refer to like elements throughout.

Figure 2:
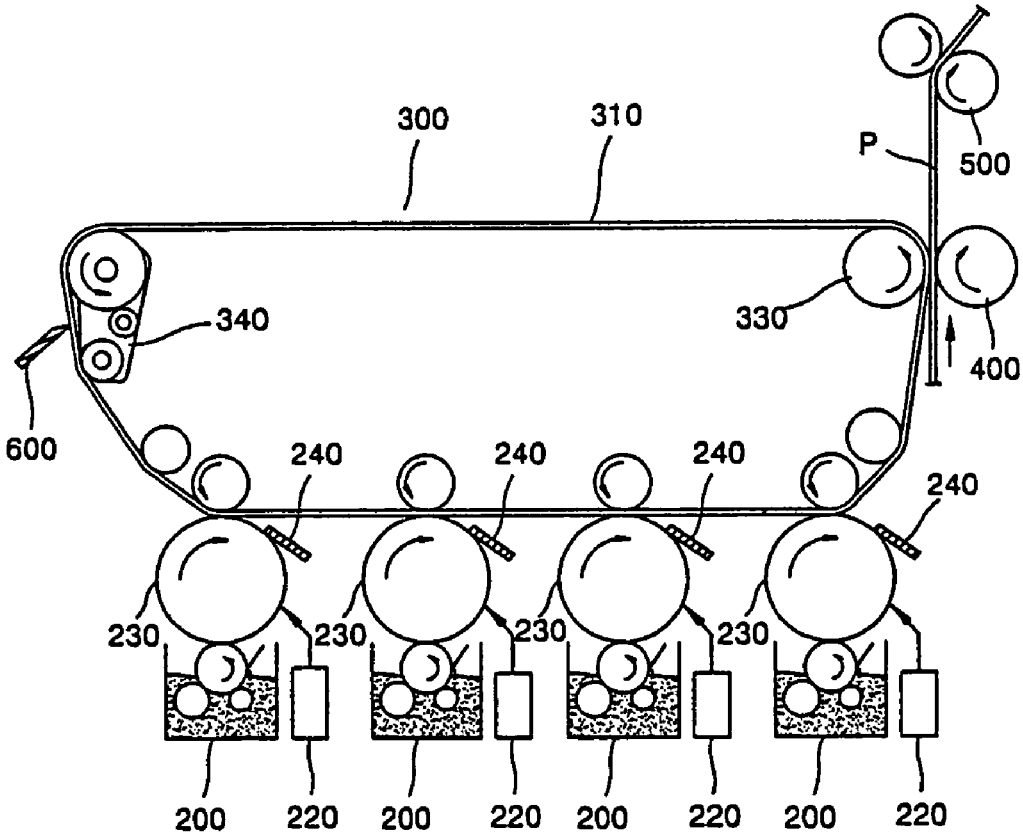
FIG. 2 schematically illustrates the structure of an electrophotographic image forming apparatus according to an embodiment of the present invention.
Figure 3:
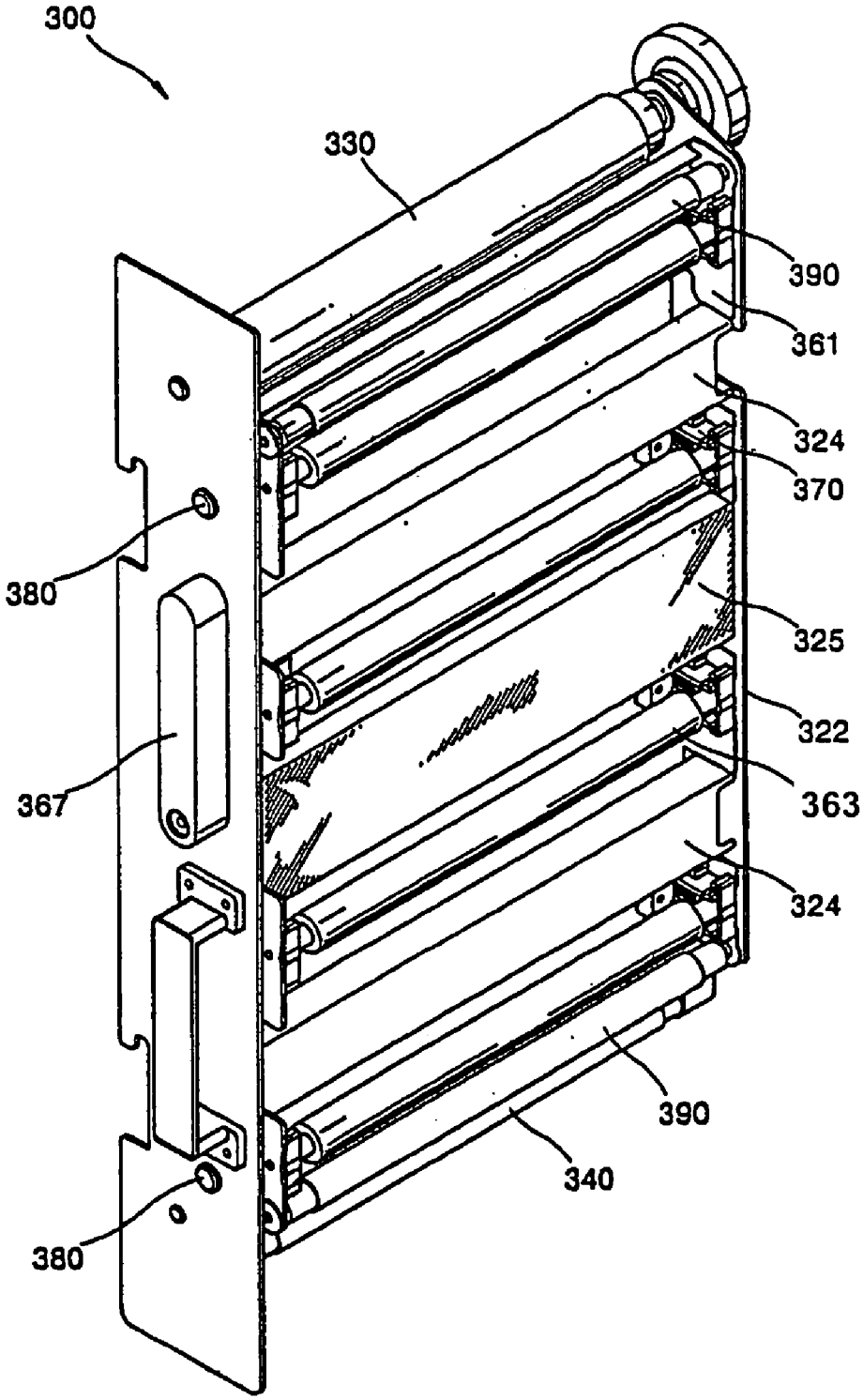
FIG. 3 is a perspective view illustrating a transfer unit according to the embodiment of the present invention.
Figure 4:
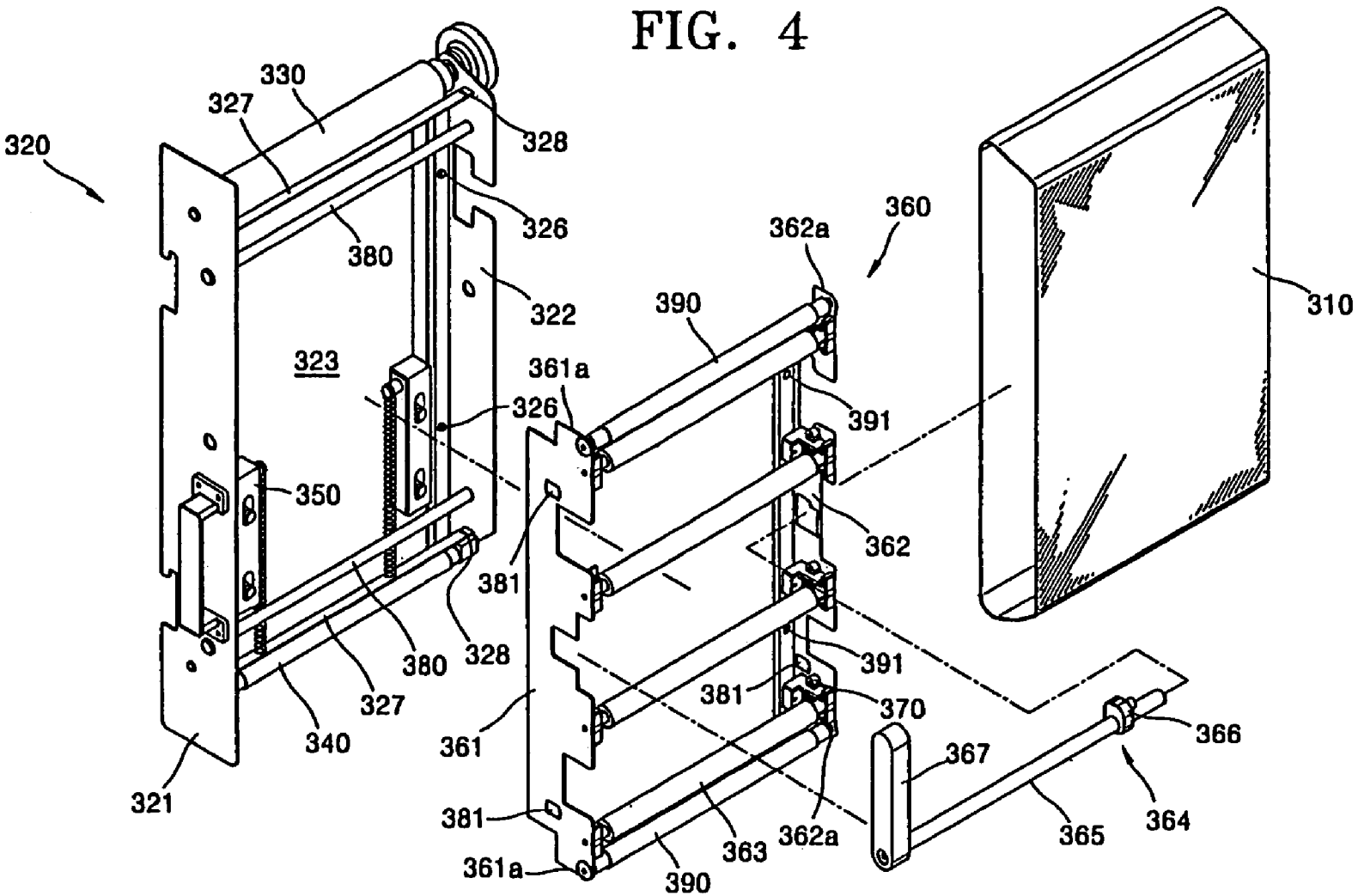
FIG. 4 is an exploded view illustrating the transfer unit according to the embodiment of the present invention.

Referring to FIGS. 2 through 4, an electrophotographic image forming apparatus according to the embodiment of the present invention includes a plurality of developing units 200 (a single developing unit will be described herein), a transfer unit 300, and a fusing unit 500. The developing unit 200 develops an electrostatic latent image formed on the surface of a photosensitive drum 230 by a laser scanning unit (LSU) 220 with a predetermined color. A photosensitive drum cleaning blade 240 removes a developing agent that is not transferred onto a transfer belt 310 and remains on the surface of the photosensitive drum 230. The photosensitive drum cleaning blade 240 contacts the surface of the photosensitive drum 230.

The transfer unit 300 transfers a toner image formed by receiving superimposed electrostatic latent images developed on the surface of the photosensitive drum 230 with a predetermined color by the developing unit 200 onto a paper P. The transfer unit 300 includes the transfer belt 310, a driving assembly 320, a transfer backup roller assembly 360, and a transfer backup roller ascending and descending portion 364.

The transfer belt 310 has a closed trace, is supported by the driving assembly 320 and the transfer backup roller assembly 360, rotated while contacting the photosensitive drum 230, and transfers the toner image formed by receiving the superimposed electrostatic latent images developed on the surface of the photosensitive drum 230 with a predetermined color.

The driving assembly 320 includes a driving roller 330, a steering roller portion 340, and a sliding portion 350.

The driving roller 330 contacts an inner surface of the transfer belt 310, is rotatably supported by a plurality of main frames 321 and 322 maintained at a predetermined interval, and drives to rotate the transfer belt 310. The driving roller 330 is connected to a driving unit (not shown) and is rotated. The plurality of main frames 321 and 322 are supported by a base 323 and a plurality of supporting members 324 and 325 and maintained at a predetermined interval.

The steering roller portion 340 is rotatably supported by the plurality of main frames 321 and 322, is opposite to the driving roller 330, is rotated while contacting the inner surface of the transfer belt 310, and tightens the transfer belt 310.

The sliding portion 350 is installed on the base 323 and pushes the steering roller portion 340 towards an outside of the transfer belt 310 so that the steering roller portion 340 tightens the transfer belt 310. A detailed description of the steering roller portion 340 and the sliding portion 350 is below.

The transfer backup roller assembly 360 includes a plurality of transfer backup rollers 363 and a plurality of guide rollers 390.

Each of the transfer backup rollers 363 is installed inside of the transfer belt 310 to be opposite to each developing unit 200 with the transfer belt 310 being placed therebetween. Each of the transfer backup rollers 363 is rotatably supported by a plurality of auxiliary frames 361 and 362, and closely adheres the transfer belt 310 to the photosensitive drum 230 so that the electrostatic latent images developed with a predetermined color are transferred from the photosensitive drum 230 onto the transfer belt 310. Each transfer backup roller 363 and each guide roller 390 is supported by the auxiliary frames 361 and 362 such that the plurality of auxiliary frames 361 and 362 are maintained at a predetermined interval.

The transfer backup roller ascending and descending portion 364 closely adheres or spaces the transfer backup roller assembly 360 to or from the developing unit 200 such that each transfer backup roller 363 installed in the transfer backup roller assembly 360 pushes or spaces the transfer belt 310 to or from the photosensitive drum 230.

The transfer backup roller ascending and descending portion 364 includes a support shaft 365, an ascending and descending member 366, and a pivoting member 367.

The support shaft 365 is rotatably supported by the main frames 321 and 322. In addition, the support shaft 365 is inserted into perforations in the auxiliary frames 361 and 362.

Figure 5:
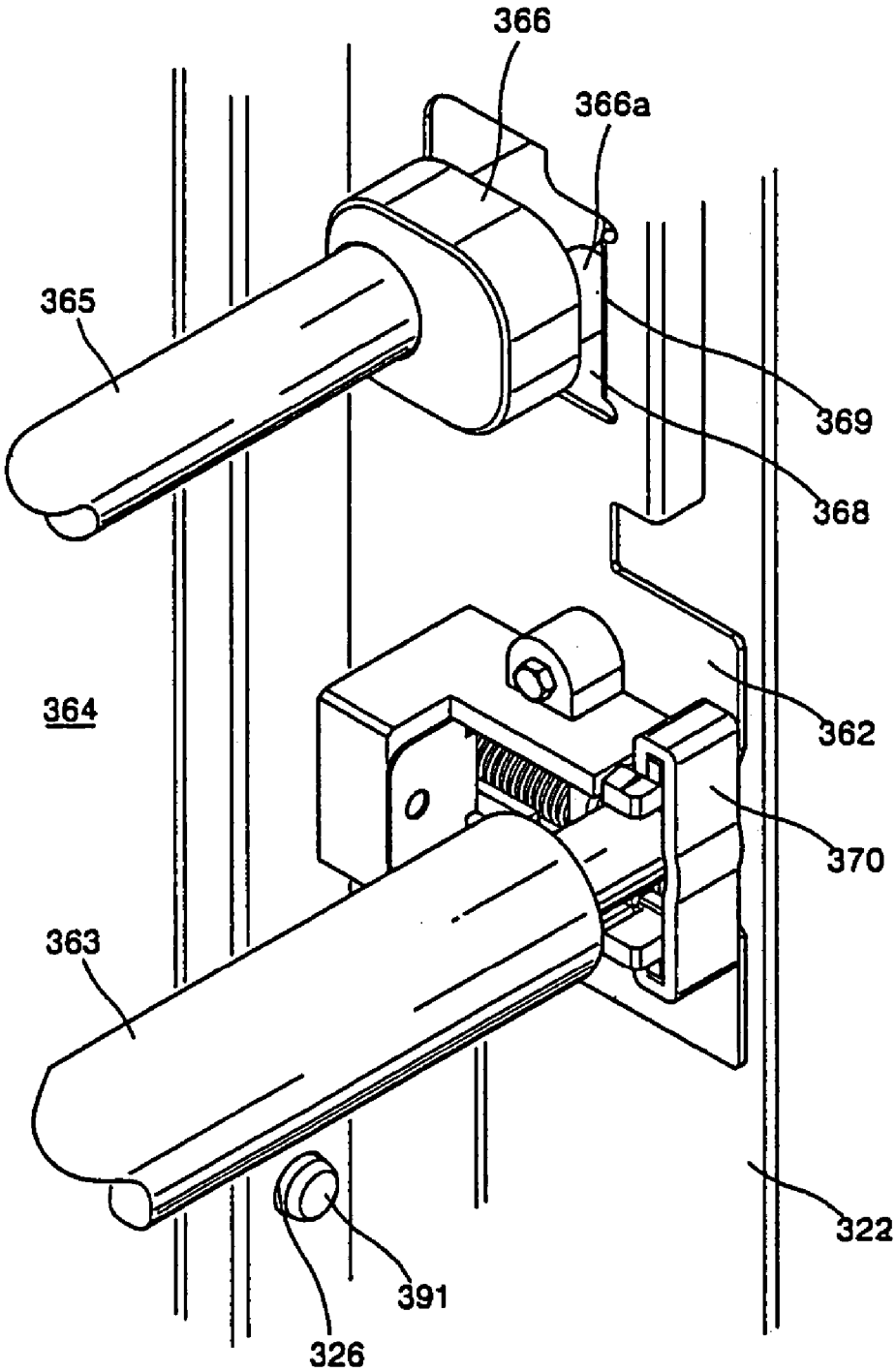
FIG. 5 is an enlarged view illustrating a part of an ascending and descending portion shown in FIG. 4.

The ascending and descending member 366 includes an ascending and descending protrusion 366*a*, as shown in FIG. 5, which is installed at one side of the support shaft 365. The ascending and descending protrusion 366*a* contacts or is spaced apart from a support jaw 369 of an ascending and descending hole 368 formed in the main frame 322 so that the transfer backup roller assembly 360 is ascended and descended with respect to the driving assembly 320. The ascending and descending protrusion 366*a* may be formed as a cam shape.

The pivoting member 367 is installed on one end of the support shaft 365 and pivots the support shaft 365. In the present embodiment, the pivoting member 367 has a handle shape. Thus, a user can pivot the support shaft 365 manually. However, the support shaft 365 may also be automatically driven by using an additional driving unit.

Figure 6A:
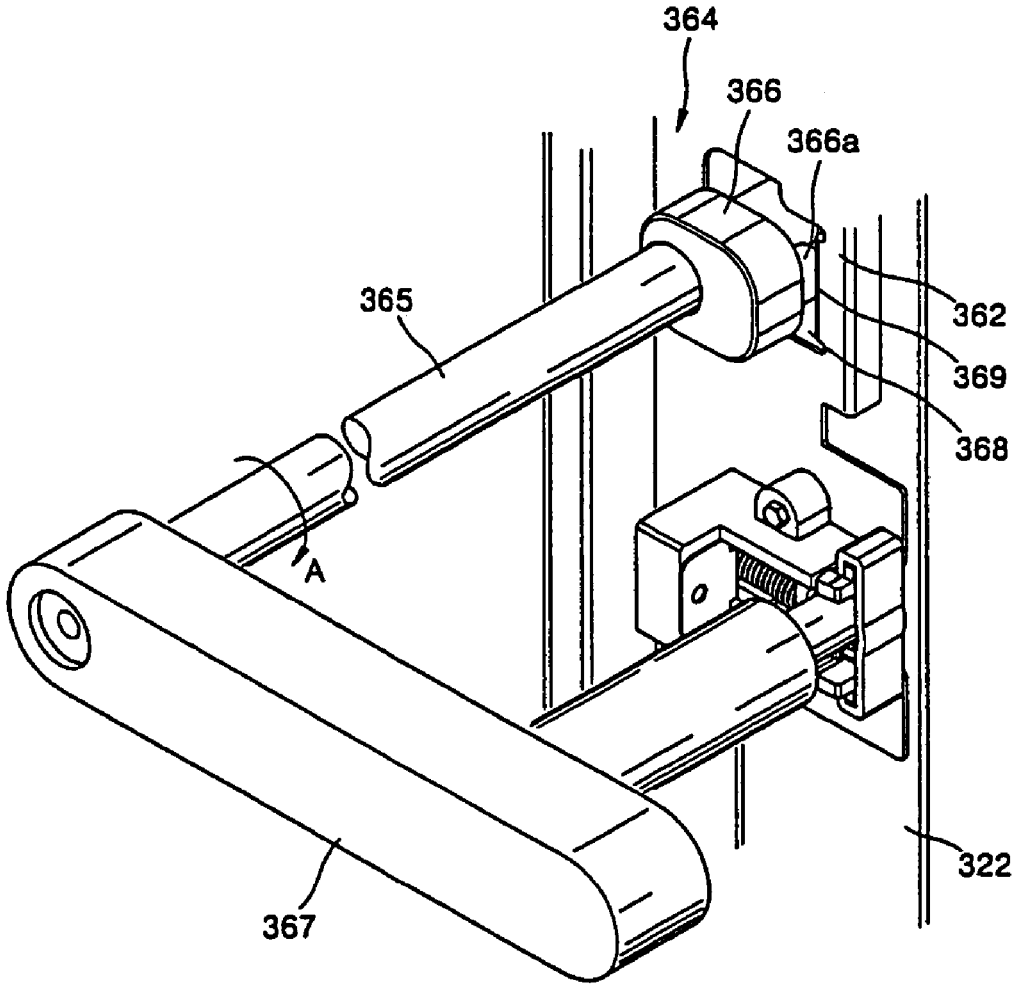
FIGS. 6A and 6B illustrate the operation of the ascending and descending portion of FIG. 5.

Referring to FIG. 6A, if the user rotates the pivoting member 367 in a direction of arrow A, the support shaft 365 and the ascending and descending member 366 are rotated together. If so, the ascending and descending protrusion 366*a* spaces the transfer backup roller assembly 360 apart from the base 323 while contacting the support jaw 369, thereby closely adhering the transfer backup roller assembly 360 to the transfer belt 310.

The pivoting member 367 is rotated in the direction of arrow A when the transfer unit 300 is combined with a main body of the image forming apparatus and performs a transfer operation.

Figure 6B:
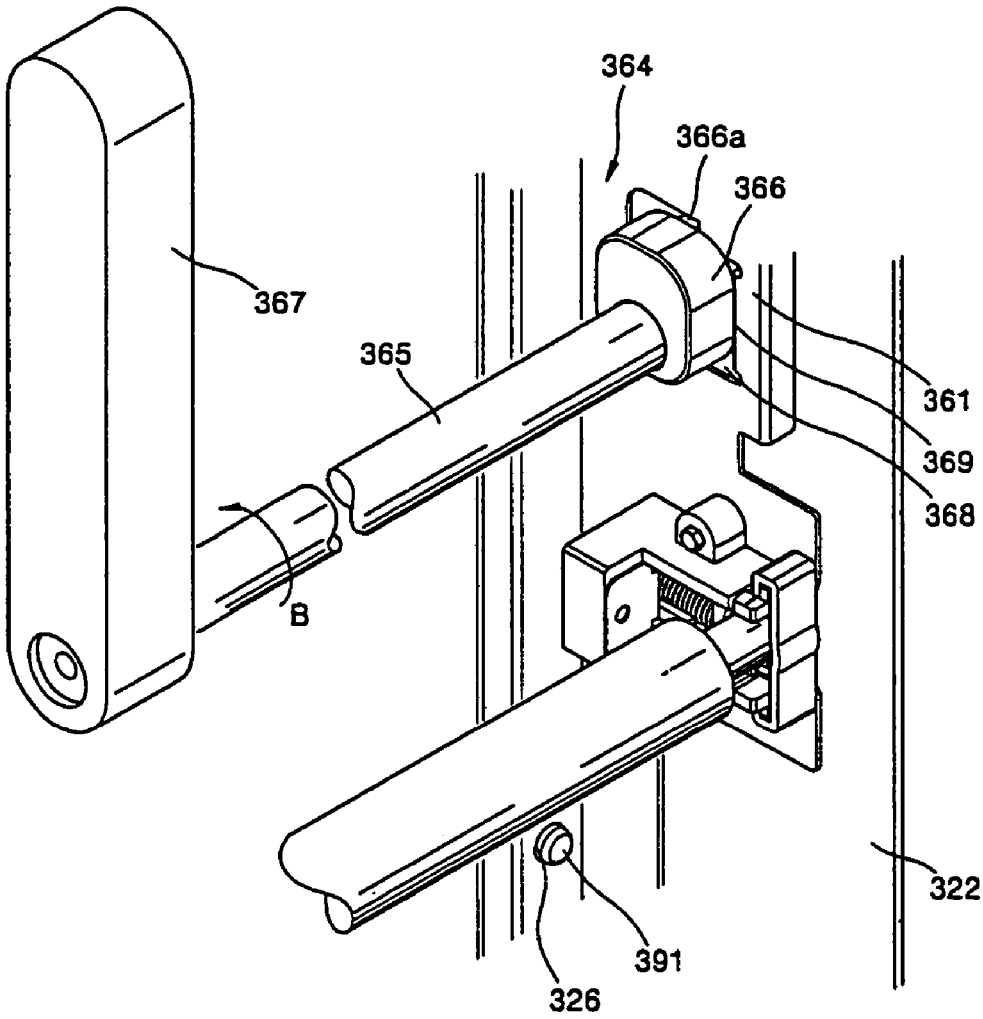

Referring to FIG. 6B, if the user rotates the pivoting member 367 in a direction of arrow B, the support shaft 365 and the ascending and descending member 366 are rotated in the direction of arrow B. If so, since the ascending and descending protrusion 366*a* is spaced apart from the support jaw 369, the transfer backup roller assembly 360 is spaced apart from the transfer belt 310.

The pivoting member 367 is rotated in the direction of arrow B when the transfer unit 300 is spaced apart from the main body of the image forming apparatus.

Figure 7:
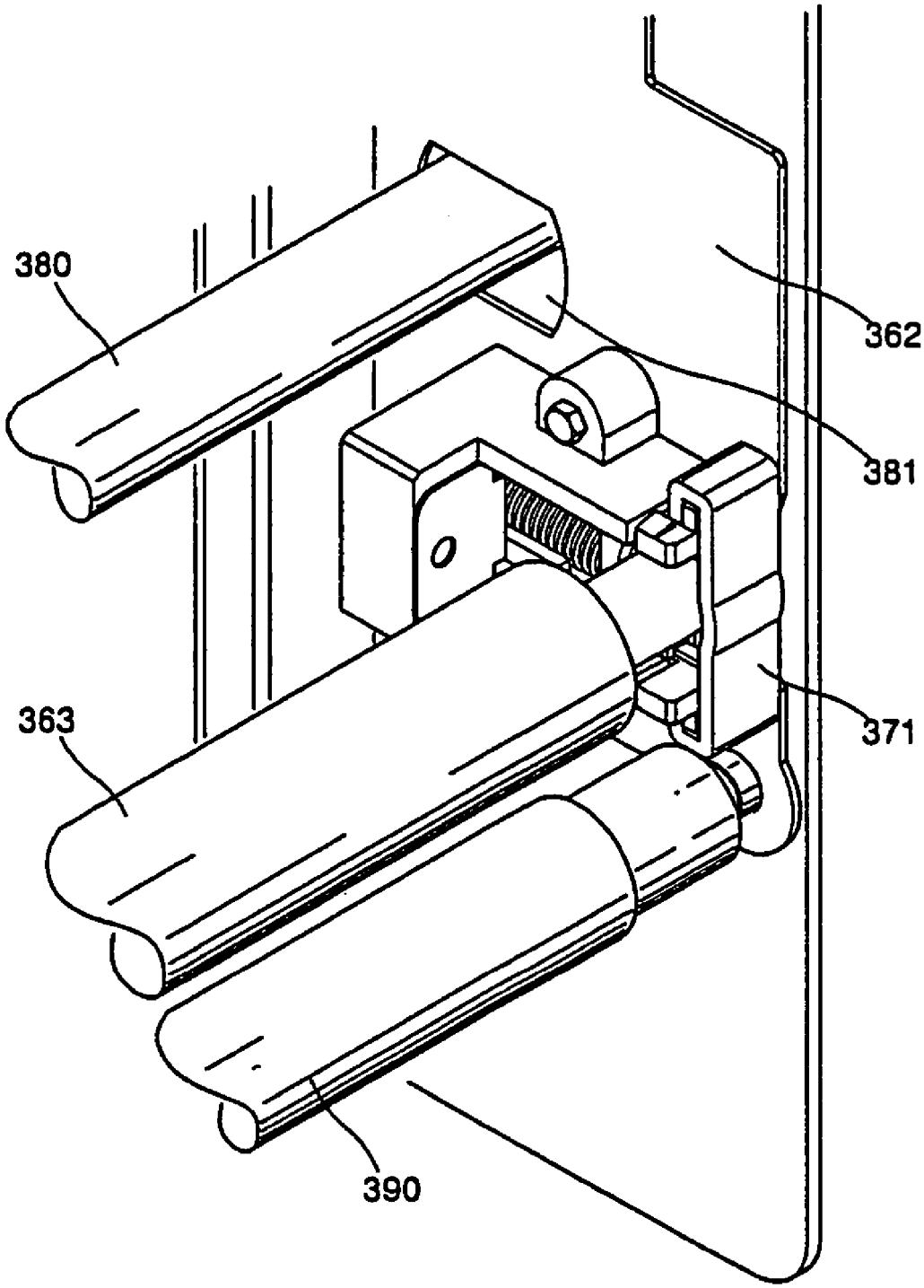
FIG. 7 is an enlarged view illustrating a part of a transfer backup roller ascending and descending portion according to the embodiment of the present invention.

FIG. 7 is an enlarged view illustrating a part of a transfer backup roller ascending and descending portion 364.

Referring to FIGS. 4 and 7, a plurality of position fixing pins 380 are installed in the transfer unit 300 so that the transfer unit 300 is combined with a correction position of the main body of the image forming apparatus. The position fixing pins 380 are inserted into perforations in the auxiliary frames 361 and 362, and both ends of each position fixing pin 380 are fixed in the main frames 321 and 322.

When the transfer backup roller assembly 360 is ascended and descended by the transfer backup ascending and descending portion 364, a plurality of support holes 381 formed in the auxiliary frames 361 and 362 prevent the position fixing pins 380 from contacting the auxiliary frames 361 and 362 such that an ascending and descending operation of the transfer backup roller assembly 360 is not disturbed.

The support holes 381 have a length larger than an ascending and descending distance in a direction in which the transfer backup roller assembly 360 is ascended and descended and have a length slightly larger than a diameter of each position fixing pin 380 so that each position fixing pin 380 supports the auxiliary frames 361 and 362 and is ascended and descended in a direction perpendicular to the transfer backup roller assembly 360. Thus, the transfer backup roller assembly 360 is supported by the plurality of the position fixing pins 380.

Meanwhile, referring to FIG. 4, a plurality of position fixing protrusions 326 are formed in the main frames 321 and 322, and a plurality of position fixing holes 391 corresponding to the position fixing protrusions 326 are formed in the auxiliary frames 361 and 362. The position fixing protrusions 326 are inserted in the position fixing holes 391 when the transfer backup roller assembly 360 is descended by the transfer backup roller assembly ascending and descending portion 364. This is because the transfer backup roller assembly 360 is supported by the position fixing protrusions 326 and the position fixing holes 391 and is not shaken against the driving assembly 320. In addition, a support plate 327 in which a plurality of support slits 328 are formed, is provided at both sides of the driving assembly 320. Both ends 361*a* and 362*a* of the auxiliary frames 361 and 362 are inserted in the support slits 328 such that the transfer backup roller assembly 360 is not shaken against the driving assembly 320.

Reference numeral 370 denotes a transfer backup roller fixing portion which fixes the plurality of transfer backup rollers 363 in the auxiliary frame 362.

Figure 8:
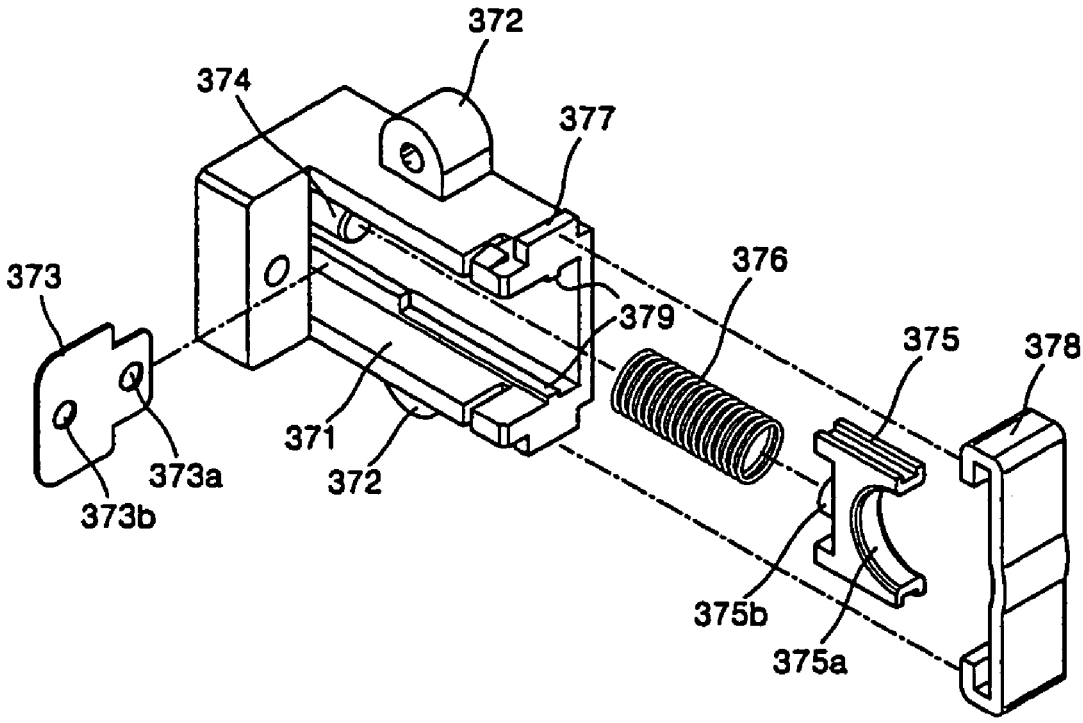
FIG. 8 is an exploded view illustrating a transfer backup roller fixing portion shown in FIG. 7.

FIG. 8 is an exploded view illustrating a transfer backup roller fixing portion 270 shown in FIGS. 4 and 7. Referring to FIG. 8, the transfer backup roller fixing portion 370 includes a main body 371 in which a fixing member 372 fixed in the auxiliary frame 362 by a fixing unit, such as a screw, is formed.

An electrode plate 373, to which current is supplied from an external power source, is installed in the main body 371. A first hole 373*a* and a second hole 373*b* are formed in the electrode plate 373. The first hole 373*a* is inserted in a fixing protrusion 374 formed in the main body 371, and the second hole 373*b* is connected to a wire (not shown) and thus is connected to the adjacent electrode plate.

In the present embodiment, additional electrode plates 373 independently exist in the transfer backup roller fixing portion 370 and are connected to the transfer backup roller fixing portion 370 using a wire.

Figure 9:
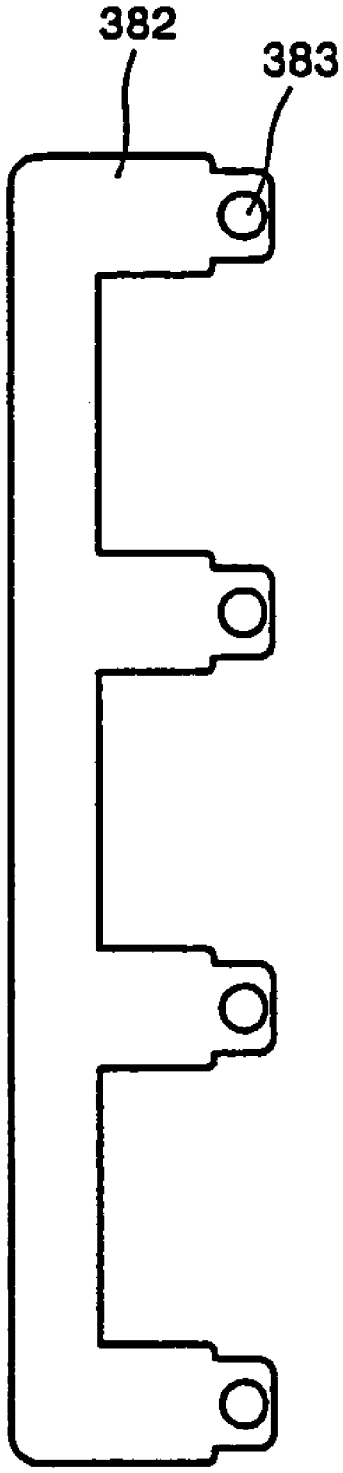
FIG. 9 illustrates an electrode plate of the transfer backup roller fixing portion according to the embodiment of the present invention.

FIG. 9 illustrates another embodiment of an electrode plate 382 of the transfer backup roller fixing portion 370. A plurality of holes 383 are formed in the electrode plate 382 so that the electrode plate 382 is connected to the transfer backup roller fixing portion 370 via one conductor. As such, the electrode plate 382 is simply connected to the transfer backup roller fixing portion 370 via the conductor, compared to the electrode plates 373 which are connected to the transfer backup roller fixing portion 370 via the wire. Current is supplied to each transfer backup roller 363, and the same bias is applied to each electrode plate 382.

The transfer backup roller fixing portion 370 includes a receiving member 375. The receiving member 375 is installed to be slid in the main body 371 and includes a receiving part 375*a* on which one end of the transfer backup roller 363 is seated, and a protrusion 375*b*.

The fixing protrusion 374 and the protrusion 375*b* are opposite to each other, and an elastic member 376 is installed therebetween. The elastic member 376 is a compression spring. An unevenness part 379 in which the receiving member 375 is inserted in the main body 371 and the transfer backup roller fixing portion 370 can be slid in the main body 371, is formed in the main body 371. If the receiving member 375 is inserted in the main body 371, the receiving member 375 is elastically biased by the elastic member 376 to be detached from the main body 371.

A hook 377 is provided in the main body 371. A detachment prevention member 378 is combined with the hook 377. The detachment prevention member 378 fixes the transfer backup roller 363 seated on the receiving member 375 in the main body 371, and simultaneously prevents the receiving member 375 from detaching from the main body 371 due to an elastic force of the elastic member 376.

The transfer backup roller fixing portion 370 pushes the transfer backup roller 363 towards the photosensitive drum 230 using the elastic member 376. If so, the transfer belt 310 is closely adhered to the photosensitive drum 230, and an image formed on the photosensitive drum 230 is smoothly transferred onto the transfer belt 310.

Meanwhile, each guide roller 390 guides the rotation of the transfer, belt 310 when the transfer belt 310 is rotated, and is installed adjacent to the transfer backup roller 363 placed on both ends of the auxiliary frames 361 and 362.

Figure 10:
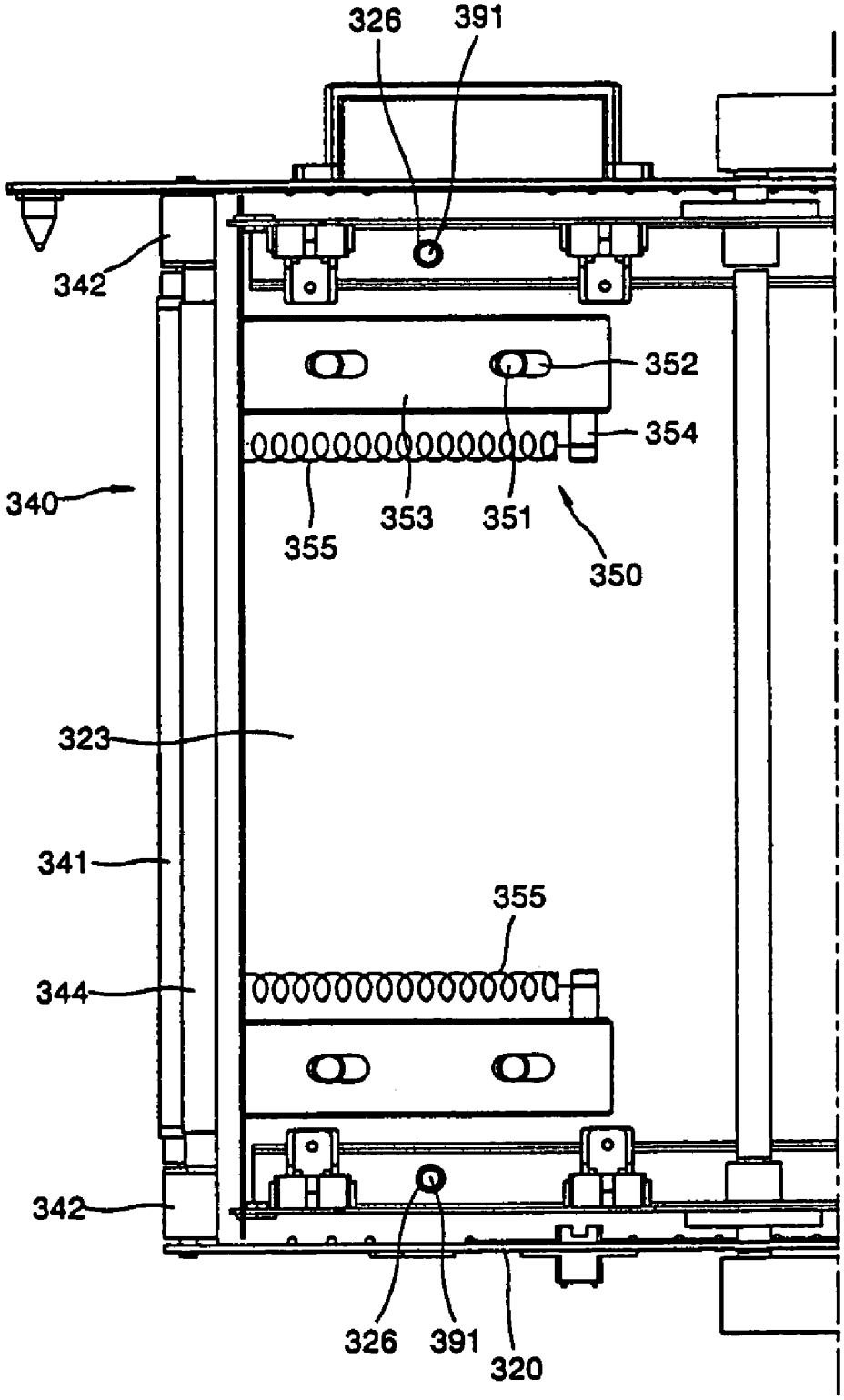
FIG. 10 is a plan view illustrating a part of the transfer unit according to the embodiment of the present invention.
Figure 11:
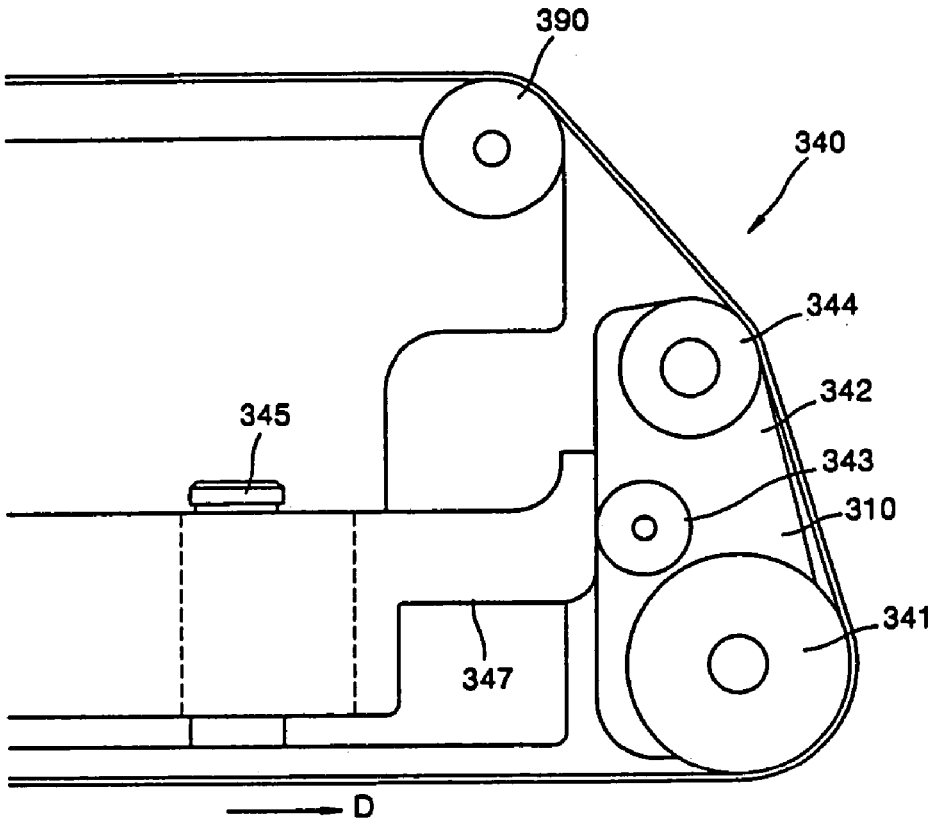
FIG. 11 is a side view illustrating a transfer belt steering assembly shown in FIG. 10.

FIG. 10 is a plan view illustrating a part of the transfer unit according to the embodiment of the invention, and FIG. 11 is a side view illustrating a transfer belt steering assembly shown in FIG. 10.

The transfer belt steering roller portion 340 includes a steering roller 341, a press roller 343, and a tension roller 344.

The steering roller 341 is rotatably installed in the main frames 321 and 322. A support part 342 is installed at both sides of the steering roller 341. The press roller 343 and the tension roller 344 are rotatably installed in the support part 342.

The sliding portion 350 pushes the steering roller portion 340 toward the transfer belt 310 such that the transfer belt 310 is tightly strained.

The sliding portion 350 includes a plurality of stoppers 351 fixed in the base 323 and a slider 353 in which sliding holes 352 to be inserted in the stoppers 351 and supported and slid are formed. A fixing part 354 is provided at one side of the slider 353, and a spring 355 which elastically biases the slider 353 towards the press roller 343, is installed in the fixing part 354. One side of the spring 355 is fixed to the support plate (327 of FIG. 4).

The slider 353 pushes the press roller 343 in a direction of arrow D using an elastic force of the spring 355. The support part 342 is pivoted centering on the steering roller 341. In this case, the tension roller 344 which is pivotably installed in the support part 342, is pivoted together. Thus, the transfer belt 310 is tightened by the tension roller 344.

Meanwhile, referring to FIG. 2, a transfer roller 400, which presses the transfer belt 310 towards the driving roller 330 so that the toner image formed on the transfer belt 310 is transferred onto the paper P, is installed opposite to the driving roller 330 wherein the transfer belt 310 is placed therebetween.

The fusing unit 500 is installed on a paper exhaust path, applies heat and pressure to the toner image transferred onto the paper P, and fuses the toner image on the paper P.

A transfer belt cleaning blade 600 is closely adhered to the transfer belt 310 with a predetermined pressure and cleans a developing agent remaining on the transfer belt 310 after the toner image is transferred from the transfer belt 310 onto the paper P.

Meanwhile, although not shown, an encoder may be installed and rotates while contacting the transfer belt 310 and measures the rotation speed of the transfer belt 310. If the rotation speed of the transfer belt 310 is measured by the encoder, a microcomputer reduces the rotation speed of the driving roller 330 when the rotation speed of the transfer belt 310 is larger than a predetermined value. In addition, the microcomputer increases the rotation speed of the driving roller 330 when the rotation speed of the transfer belt 310 is smaller than the predetermined value.

As described above, the transfer unit of an electrophotographic image forming apparatus according to the embodiment of the present invention has the following advantages. First, a plurality of transfer backup rollers can be closely adhered to or spaced apart from a transfer belt by a transfer backup roller ascending and descending portion at the same time, so a simple operational capability and high precision can be achieved. Second, a transfer backup roller has transfer backup roller fixing portions respectively at both ends, and thus can be pushed towards the transfer belt. Third, each electrode plate is connected to the transfer backup roller fixing portion via a one bias-applying connector, so the same bias can be applied to each electrode plate.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A transfer unit of an electrophotographic image forming apparatus having a plurality of photosensitive drums, the transfer unit comprising:

a transfer belt which has a closed shape, is rotated while contacting the photosensitive drums, onto which toner images formed on the photosensitive drums are transferred, and which transfers the toner images onto a paper;

a plurality of main frames;

a driving assembly having:

a driving roller which is installed inside of the transfer belt to be supported by the plurality of main frames and rotates and drives the transfer belt, and a steering roller portion which is installed inside of the transfer belt to be supported by the plurality of main frames and to push the transfer belt from the inside thereof to tighten the transfer belt;

a plurality of auxiliary frames;

a transfer backup roller assembly having:

a plurality of transfer backup rollers which are installed inside of the transfer belt to be opposite to the photosensitive drums, the transfer belt being between the transfer backup rollers and the photosensitive drums and supported by the plurality of auxiliary frames and to support the transfer belt so that the toner images formed on the photosensitive drums are transferred onto the transfer belt, and a plurality of guide rollers which are inside of the transfer belt to be supported by the plurality of auxiliary frames and guide the transfer belt; and a transfer backup roller ascending and descending portion which ascends and descends the transfer backup roller assembly towards and away from the driving assembly.

2. The transfer unit of claim 1, wherein the transfer backup roller ascending and descending portion comprises:

a support shaft which is inserted into perforations in the auxiliary frames and is supported by the main frames;

an ascending and descending member having an ascending and descending protrusion which is installed at a first side of the support shaft, to contact the auxiliary frames as the support shaft is pivoted, and ascends and descends the transfer backup roller assembly towards and from the driving assembly; and a pivoting member which is installed at a second side of the support shaft opposite the first side of the support shaft and pivots the support shaft.

3. The transfer unit of claim 2, further comprising:

an ascending and descending hole formed in one of the auxiliary frames; and a support jaw to ascend the transfer backup roller assembly towards the driving assembly while the ascending and descending member is rotated.

4. The transfer unit of claim 2, further comprising:

a plurality of transfer backup roller fixing portions in which the transfer backup rollers are respectively rotatably supported, each of the transfer backup roller fixing portions including:

a fixing member which is fixed in the respective auxiliary frame and including an electrode plate to which current is supplied, a receiving member having a hook which is installed to be slid in the fixing member and on which one end of the respective transfer backup roller is seated, an elastic member which elastically biases the receiving member to be detached from the fixing member, and a detachment prevention member which is combined with the hook, provided in the fixing member and to prevent the respective transfer backup roller from detaching from the receiving member due to an elastic force of the elastic member.

5. The transfer unit of claim 4, wherein the receiving members each include:

a receiving part on which the respective transfer backup roller is seated, and a protrusion connected to the respective elastic member.

6. The transfer unit of claim 5, wherein the electrode plates are inserted in fixing protrusions respectively formed in the fixing members.

7. The transfer unit of claim 6, wherein the elastic members are placed between the fixing protrusions and the protrusions of the receiving members.

8. The transfer unit of claim 4, wherein the elastic members and the receiving members are made of a conductive material.

9. The transfer unit of claim 4, wherein each of the electrode plates is made of a conductor and each of the electrode plates receives a same bias so that a current is supplied to each of the transfer backup rollers.

10. The transfer unit of claim 1, further comprising a base having a sliding portion within the main frames, wherein the steering roller portion comprises:

a steering roller which is rotatably installed in the main frames;

a plurality of support parts respectively installed at first and second sides of the steering roller;

a press roller which is installed in the support parts and is elastically biased by the sliding portion; and a tension roller which is installed in the support parts, to contact an inside of the transfer belt, and tighten the transfer belt.

11. The transfer unit of claim 10, wherein the sliding portion comprises:

a plurality of stoppers installed in the base;

a slider in which a sliding hole to be inserted in the stoppers and slid is formed, an end thereof to contact the press roller; and a fixing part at one side of the slider;

an elastic member, which is installed in the fixing part to elastically bias the slider towards the press roller.

12. The transfer unit of claim 11, wherein the elastic member is a spring.

13. The transfer unit of claim 1, further comprising a transfer roller which is installed opposite to the driving roller, wherein the transfer belt is placed therebetween, and the transfer roller transfers the images from the transfer belt onto the paper.

14. The transfer unit of claim 1, further comprising a plurality of position fixing pins which are inserted into perforations in the auxiliary frames, are supported by the main frames, and support the transfer backup roller assembly.

15. The transfer unit of claim 14, further comprising a plurality of support holes formed in the auxiliary frames, to prevent the position fixing pins from contacting the auxiliary frames so that an ascending and descending operation of the transfer backup roller assembly is not disturbed.

16. The transfer unit of claim 15, wherein the support holes have a length larger than an ascending and descending distance of the transfer backup roller assembly.

17. The transfer unit of claim 15, wherein the support holes have a length larger than a diameter of the position fixing pins.

18. The transfer unit of claim 1, further comprising:

a plurality of position fixing protrusions respectively formed in the main frames; and a plurality of position fixing holes corresponding to the position fixing protrusions and respectively formed in the auxiliary frames, wherein the position fixing protrusions are inserted in the position fixing holes when the transfer backup roller assembly is descended by the transfer backup roller assembly ascending and descending portion.

19. An apparatus, comprising:

a plurality of photosensitive drums;

a transfer belt to receive images from the photosensitive drums; and a transfer unit to transfer the images from the photosensitive drums to the transfer belt, comprising:

a plurality of first frames, a transfer backup roller assembly including:

a plurality of transfer backup rollers respectively opposite the photosensitive drums, and a transfer backup roller moving portion which moves the transfer backup rollers towards or away from the photosensitive drums.

20. The apparatus of claim 19, further comprising:

a plurality of second frames;

a driving roller supported by the second frames to drive the transfer belt; and a steering roller supported by the second frames to tighten the transfer belt.

21. The apparatus of claim 19, further comprising:

a plurality of guide rollers supported by the plurality of first frames to guide the transfer belt.

22. The apparatus of claim 19, wherein the transfer backup roller moving portion moves all of the transfer backup rollers towards or away from the photosensitive drums at the same time.

23. An apparatus, comprising:

a plurality of photosensitive drums;

a transfer belt to receive images from the photosensitive drums; and a transfer unit to transfer the images from the photosensitive drums to the transfer belt, comprising:

a plurality of transfer backup rollers respectively opposite the photosensitive drums, and a transfer backup roller moving portion which moves all of the transfer backup rollers towards or away from the photosensitive drums at the same time.

* * * * *

UNITED STATES PATENT AND TRADEMARK OFFICE

CERTIFICATE OF CORRECTION

PATENT NO. : 6,999,709 B2
APPLICATION NO. : 10/687965
DATED : February 14, 2006
INVENTOR(S) : Geun-yong Park It is certified that error appears in the above-identified patent and that said Letters Patent is hereby corrected as shown below:

On Title Page: Item (54) Title, Column 1, line 3, replace “APPRARATUS” with --APPARATUS--, therefor;

Column 1, line 3, replace “APPRARATUS” with --APPARATUS--, therefor.

Signed and Sealed this

Fifth Day of December, 2006

JON W. DUDAS
*Director of the United States Patent and Trademark Office*